US006331241B1

(12) United States Patent
Ilgar

(10) Patent No.: US 6,331,241 B1
(45) Date of Patent: Dec. 18, 2001

(54) METHOD OF MAKING CHROMIUM-PLATED STEEL

(75) Inventor: Ersan Ilgar, Kirtland, OH (US)

(73) Assignee: USX Corporation, Pittsburgh, PA (US)

( * ) Notice: Subject to any disclaimer, the term of this patent is extended or adjusted under 35 U.S.C. 154(b) by 0 days.

(21) Appl. No.: 09/624,292

(22) Filed: Jul. 24, 2000

(51) Int. Cl.[7] ..... C25D 3/04
(52) U.S. Cl. ..... 205/283
(58) Field of Search ..... 205/283

(56) References Cited

U.S. PATENT DOCUMENTS

| | | | |
|---|---|---|---|
| 3,642,587 | 2/1972 | Allen | 204/35 N |
| 3,903,237 | 9/1975 | Smith et al. | 423/54 |
| 4,432,842 | 2/1984 | Inui et al. | 204/41 |
| 4,519,879 | 5/1985 | Ichida et al. | 204/35.1 |
| 4,579,633 | 4/1986 | Kobayashi et al. | 204/27 |
| 4,746,414 | 5/1988 | Carpenter et al. | 204/240 |
| 4,875,983 | 10/1989 | Alota et al. | 204/28 |
| 5,168,015 | 12/1992 | Shimizu et al. | 428/629 |
| 6,004,448 | 12/1999 | Martyak | 205/178 |

OTHER PUBLICATIONS

Marcel Pourbaix, Atlas of Electrochemical Equilibria in Aqueous Solutions, National Association of Corrosion Engineers, 2nd English Edition, 1974, pp. 256–271: Chromium, No month available.

Fukuda et al, "Process for Coating Tin–Free Steel with Layers of Metallic Chromium . . . " J. Electrochem. Soc., Mar. 1969, 398–402.

Edwin J. Smith "Chromium Coated Steel for Container Applications" Technical Seventy–Fifth General Meeting, 265–286, No month available.

A. T. Kuhn Industrial Electrochemical Processes Elsevier Publishing Company 1971, 354–360: "Electrodeposition of Chromium," No month available.

*Primary Examiner*—Kathryn Gorgos
*Assistant Examiner*—Thomas H Parsons
(74) *Attorney, Agent, or Firm*—William L. Krayer

(57) ABSTRACT

Chromium electroplating of steel strip, to make tin-free steel, is conducted in an electrolytic bath containing predominantly $HCrO_4^-$ ions rather than the conventional $[HCr_2O_7]^-$ or $Cr_2O_7^=$ ions. The electrolytic bath is dilute, reducing the amount of chrome-containing waste, and the dilute chromic acid rinse water may be recycled to the electrolytic bath, thus eliminating the waste disposal problem of the rinse water.

14 Claims, 3 Drawing Sheets

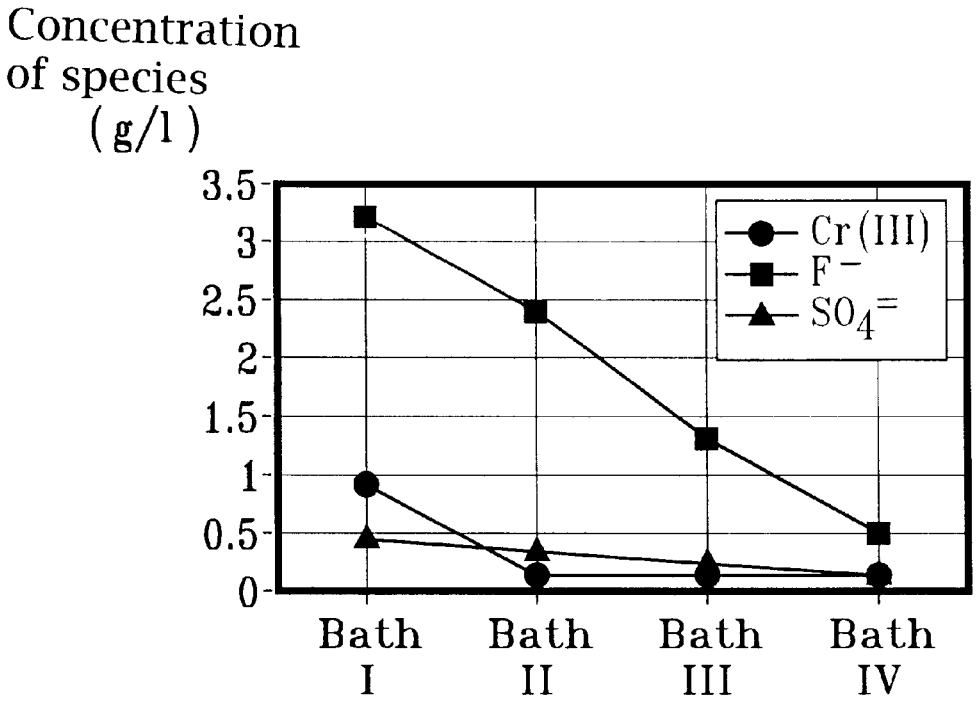
Fig. 2 Concentrations of Cr(III), $F^-$, $SO_4^=$ ions chromic acid baths.
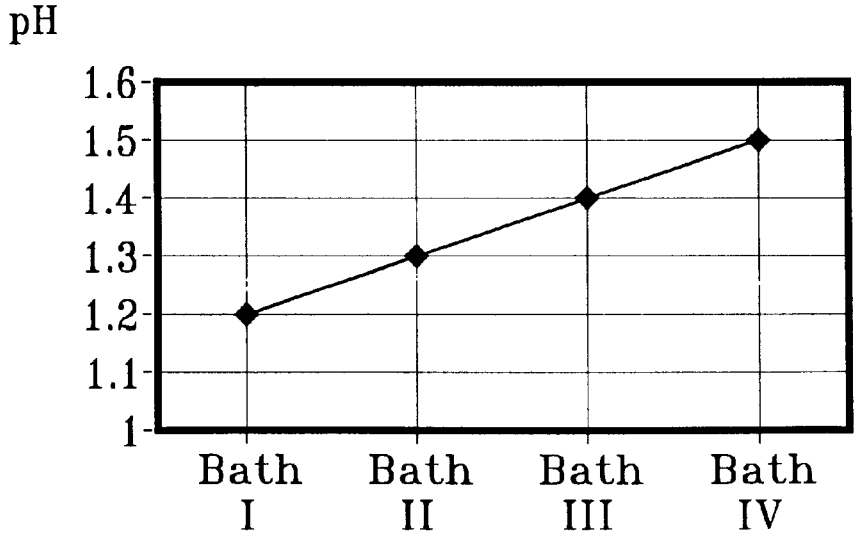
Fig. 3 pH of the chromic acid baths.

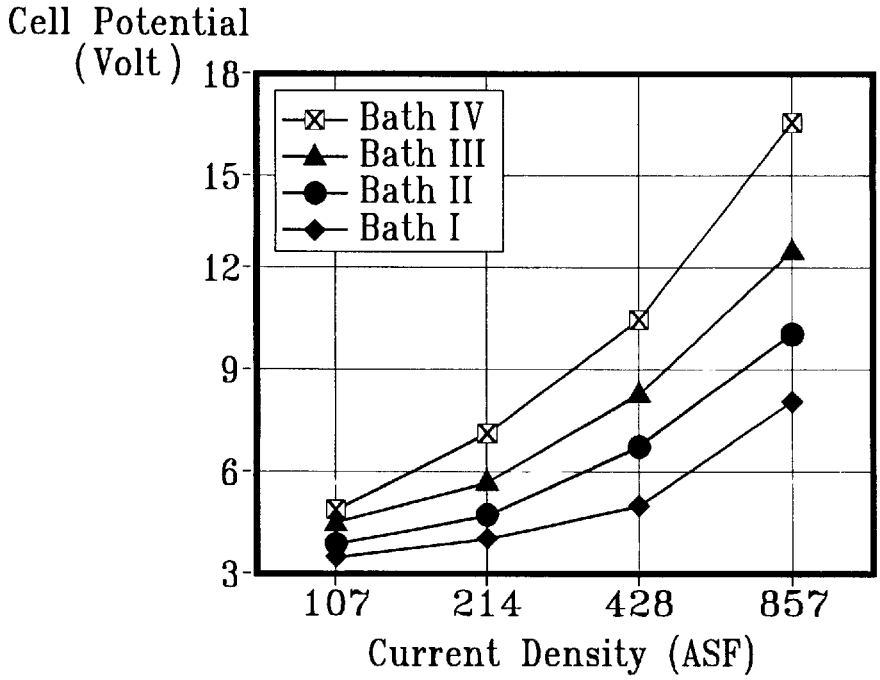
Fig. 4 Effect of chromic acid concentration and current density on TFS plating voltage.
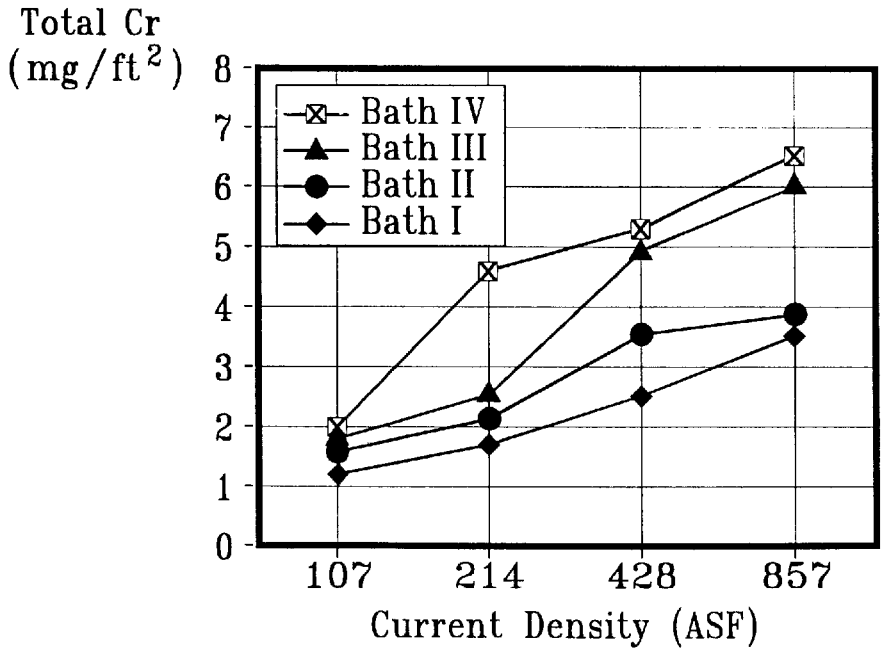
Fig. 5 Effect of chromic acid concentration and current density on current efficiency (coating weight) at 125°F and 600 feet/minute.

METHOD OF MAKING CHROMIUM-PLATED STEEL

BACKGROUND OF THE INVENTION

1. Technical Field

This invention relates to a method of thin plating steel with chromium; more particularly, it relates to the use of an electrolyte of a particular ionic form to make "tin-free steel."

2. Description of the Related Art

In the American steel industry, low carbon sheet steel thinly plated with chromium is generally referred to as tin free steel ("TFS"). In Europe and Asia, the same type of product is more commonly called electrolytically chromium coated steel ("ECCS"). In either case, the typical practice is to prepare an electrolyte containing 70 to 120 grams per liter of $CrO_3$, (chromic acid) together with small amounts of sulfate ions (about 0.2–0.8 grams per liter) and fluoride ions (about 1.0 to 5.0 grams per liter). This invention does not concern the making of decorative and hard chromium plates, which utilizes baths containing generally 200 to 400 g/L.

In the manufacture of TFS, the sheet steel is utilized as the cathode in an electrolytic cell for the solution, power is applied, and a coating of chromium metal is formed on the sheet steel. Typically, the finished product will have a layer of 3 to 13 milligrams per square foot of metallic chromium (a common target is 5 mg/ft$^2$) and will have a layer of about 0.5 to 1.5 mg/ft$^2$ chromium oxide on top of the metallic chromium. The strip must be rinsed quickly and properly to avoid significant staining. Large quantities of this product are made by continuous strip plating.

The conventional electrolytic chrome treatment as described above presents formidable environmental problems and expense. One response to these problems and expense is to search for a way to reduce the amount of waste electrolyte generated. The literature, however, discourses an approach of reducing the quantity of chromic acid in the electrolyte. See, for example, lines 2–32, of column 4 of Allen et al U.S. Pat. No. 3,642,587: "Forty g/l of $CrO_3$ has been found to be a minimum amount useful in the baths contemplated herein because below that amount bright chromium plate cannot be obtained by the process of the invention, and, further, a heavy, dark-colored coating of hydrated chromium oxide is produced." The baths used by Allen et al included sulfate and fluoride catalysts.

A study by Marcel Pourbaix, "Atlas of Electrochemical in Equilibria in Aqueous Solutions," National Association of Corrosion Engineers, Houston (Library of Congress 65–11670), Second English Edition 1974, pages 256–271, illustrates the complexity of the chromate ion and its various states in aqueous solution. Numerous forms of chromate ions are shown. But, although the term "hexavalent chromium" is commonly used, a simple $Cr^{+6}$ ion has never been identified. When chromium trioxide ($CrO_3$) dissolves in water, it forms chromic acid: $CrO_3+H_2O \rightarrow H_2CrO_4$ (Equation 1). The chromic acid is at equilibrium with $HCrO_4^-$ (acid chromate ion) and $Cr_2O_7^=$(dichromate ion) as shown in $H_2CrO_4 \longleftrightarrow HCrO_4^-+H^+$ (Equation 2) and $2H_2CrO_4^= \leftrightarrow Cr_2O_7^=+H_2O+2H^+$ (Equation 3). Three types of hexavalent anion are generated: $HCrO_4^-$, $CrO_4^=$, and $Cr_2O_7^=$; their concentrations in the solution depend on the pH and the initial $CrO_3$ concentration. It is known, as pointed out in "Industrial Electrochemical Processes" edited by A. T. Kuhn, Elsevier Publishing Company (1971) page 354, that "(T)he $[HCrO_4]^-$ ion predominates in dilute $CrO_3$ solutions, whereas the $[HCr_2O_7]^-$ ion is formed preferentially in concentrated solutions, such as those that are used for plating baths." The $[HCr_2O_7]^-$ ion may also exist as $Cr_2O_7^=$. This publication goes on to discuss the importance of the presence of trivalent chromium to the deposition of the chromium layer, particularly focusing on the role of the sulfuric acid catalyst in preventing the formation of an impermeable film primarily of $Cr(OH)CrO_4$.

It is desirable to reduce the environmental consequences in the manufacture of tin free steel in spite of the complexities presented by chromate electrochemistry.

SUMMARY OF THE INVENTION

Contrary to the practice of the prior art, which employs primarily $[HCr_2O_7]^-$ ions, my process involves the use of acid dichromate ions—$HCrO_4^-$—in the electrolyte bath. My electrolyte baths include sulfate and fluoride ions as well, preferably in concentrations about 1/100 of chromium ion present. I may make up the solution using $CrO_3$, but permit primarily $HCrO_4^-$ to exist in the bath as it is used. Workers in the art may prefer to express the concentration in more familiar terms as $CrO_3$, in which case it may be said that the $CrO_3$ is dissolved and optionally diluted to provide a concentration from 5 to 35 grams per liter, preferably 20 to 30 g/l. The pH may vary from 1.0 to 1.5, which will cause the $HCrO_4^-$ concentration to change accordingly. My invention utilizes an electrolytic bath including $CrO_3$ at 5 to 35 g/l at a pH between 1.0 and 1.5, yielding $HCrO_4^-$ at concentrations of 5.8 to 40.6 g/L. The solutions include sulfuric acid in amounts to provide sulfate ions, and a source of fluoride ions, sufficient for effective enhancement of chromium deposition, preferably in concentrations from 50 to 200 ppm sulfate ions, and fluoride ions in concentration from 500 to 2000 ppm. Generally, the process may employ 100–1000 Amperes/square foot, (with a voltage of 3–17 depending on the current density) and provide a residence time of, preferably, 5–15 seconds. Temperature of the bath is not critical, but 100–30° F. is preferred.

My process provides several benefits in addition to the amelioration of the disposal problems associated with chrome plating. For example, while providing good lacquer adhesion, the process exhibits increased current efficiency, it reduces the cost of chromic acid additions to the bath, it minimizes surface staining problems, since diluted drag-out film is easier to rinse, it minimizes maintenance cost by reducing the corrosion to the process equipment, and it stabilizes the Cr(III) concentrations. Instability of Cr(III) concentration is known to decrease current efficiency in chrome plating.

BRIEF DESCRIPTION OF THE DRAWINGS

FIG. 2 is a plot showing the concentrations of trivalent chromium, fluorine ion, and sulfate ion in the tests described herein.

FIG. 3 is a plot showing the pH of the electrolytic baths described herein.

FIG. 4 is a graph showing the effect of concentration of $CrO_3$ added (shown in the form of $HCrO_4^{31}$ in the case of Baths 3 and 4) and current density on plating voltage in the experiments described.

FIG. 5 is a graph showing the effect of $CrO_3$ added (in the form of $HCrO_4^-$ in the case of Baths 3 and 4) and current density on the current efficiency (coating weight) at 125° F. and 600 feet per minute.

DETAILED DESCRIPTION OF THE INVENTION

Figure 1:
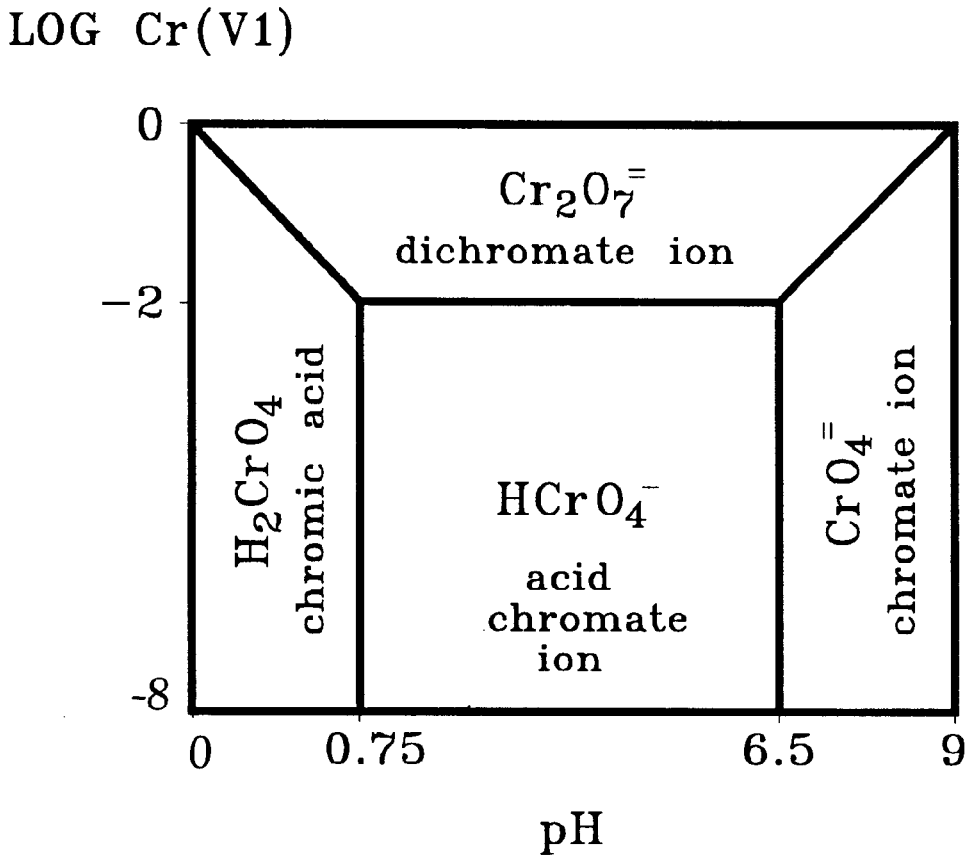
FIG. 1 is a diagram derived from a similar diagram in the above cited Pourbaix article, showing the domains of prevailing chromic acid ion forms, plotting concentration against pH.

Certain experiments were performed to demonstrate the invention. In the following description, reference will be made to Tables 1–5 and FIGS. 2–5. When referring to the incorporation of chromic acid, it will be expressed conventionally as $CrO_3$ although I assure that, in those electrolyte solutions within my invention, it is present in the ionized form $HCrO_4^-$. See FIG. 1.

A conventional chromic acid solution for a TFS process was prepared to give a composition of approximately 100 g/l $CrO_3$, 0.4 g/l $SO_4^=$ ions, added as $H_2SO_4$, and 3.2 g/l F ions, added as $H_2SiF_6$. This is designated bath number 1. The diluted baths 2, 3, and 4 were prepared from bath number 1 by dilution with water to give 50, 25, and 12.5 g/l chromic acid concentrations. The TFS coatings were produced in a laboratory circulating electroplating cell. Prior to electroplating, blackplate panels with a plating area of 8 by 2.5 inches were cathodically electrocleaned in a commercial alkaline cleaner at 180° F. for 10 seconds, rinsed in warm water, immersed in 5 percent $H_2SO_4$ solution for 3 seconds, rinsed in warm water, and placed on the cathode side of the electroplating circulation cell. A volume of 20 liters of plating solution was heated to 120° F. in the reservoir and was pumped into the plating cell which contained a Pb—Ag anode and a blackplate cathode connected to a rectifier. The electrolyte flowed upward at a rate of 200 and 600 feet/min. between the electrodes and fell down by gravity to the reservoir. Electrodeposition of chromium/chromium oxide onto the blackplate was conducted at 107, 214, 428 and 857 Amp/ft$^2$ (ASF) with a constant coulomb of 24 Amp sec., with an aim of 5 mg/ft$^2$ coating weights. After the plating was completed, the panels were rinsed, squeegeed off, and hot air dried.

The coating weights were determined by chromatography for metallic Cr and elipsometer for $CrO_x$ layers. The lacquer adhesion performance of the TFS panels was determined according to ASTM D3359 specifications. An epoxy-phenolic type lacquer was applied on the TFS coatin with approximately 16 mg/4 in$^2$ and cured at 410° F. for 10 minutes. The lacquered panels were scribed down to the steel substrate. Then an adhesive tape made for this purpose was applied and rubber onto the surface. The tape was pulled rapidly, and the panels were inspected. The adhesion was rated according to ASTM specifications (0 is for adhesion loss >65% and 5 means no adhesion loss).

The composition of the chromic acid baths, reported as hexavalent chromium (CrVI), used in this study is shown in Table 1. It was noted all the ions in the chromic acid bath with the exception of trivalent chromium [Cr(III)] were reduced in concentrations proportionally with the dilution factor. The Cr(III) ions were reduced from 1.0 g/l to 0.1 g/l after first dilution to 50 g/l and remained at the same level for the further dilutions. In baths 3 and 4 the Cr(VI) ions are predominantly $HCrO_4^-$. Dilution of the chromic acid bath caused an increase in plating cell voltage of the bath (See Table 2 and FIG. 4). "ASF" means amperes per square foot.

TABLE 1

Composition of Chromic Acid Baths Used in this Study

| | | Measured Concentration (grams/liter) | | | | |
|---|---|---|---|---|---|---|
| Bath # | $CrO_3$ (g/l) | Cr(VI) | Cr(III) | F | $SO_4^-$ | PH |
| 1 | 100 | 40 | 1.0 | 3.2 | 0.4 | 1.2 |
| 2 | 50 | 22.7 | 0.1 | 2.4 | 0.2 | 1.3 |
| 3 | 25 | 14 | 0.1 | 1.3 | 0.1 | 1.4 |
| 4 | 12.5 | 8.5 | 0.1 | 0.6 | 0.06 | 1.5 |

TABLE 2

Effect of Chromic Acid Concentration and Current Density On Cell Voltage at 125° F. Plating Tests

| | Measured Cell Voltage (Volts) | | | |
|---|---|---|---|---|
| Bath | 107 ASF | 214 ASF | 428 ASF | 857 ASF |
| 1 | 3.5 | 4.0 | 5.5 | 8.0 |
| 2 | 3.8 | 4.5 | 6.7 | 10.0 |
| 3 | 4.0 | 5.8 | 8.0 | 12.5 |
| 4 | 4.5 | 7.2 | 10.5 | 17.0 |

As seen in FIG. 2, the concentrations of $SO_4^=$ and $F^-$ decrease as a function of $CrO_3$ concentration. The Cr(III) concentration, however, remains constant after the first dilution from 1 g/L to 0.1 g/L.

FIG. 3 shows the effect of dilution on pH. Dilution reduces $H^+$, which results in an increase in pH. This effect favors Equation 2 above, tending to increase the proportion of $HCrO_4^-$ ions.

An important finding shown in Table 3 and FIG. 5 is that dilution of the chromic acid bath results in higher current efficiencies (higher coating weight, preferably 20–40%, per coulomb). This was probably due to an increase in pH and/or a decrease in Cr(III) concentration. It is known that the Cr(III) in the chromic acid bath reduces the current efficiencies. Additionally, the lower the pH (higher hydrogen ion concentration), the more the amount of hydrogen gas deposition at the cathode as a cathodic reaction which is also responsible for the lower current efficiencies. A dilution of the chromic acid provides higher current efficiencies because of a reduction in the Cr(III) ions and an increase in the pH. Additionally, it was shown that the higher the current densities applied the higher the current efficiencies (FIG. 5).

TABLE 3

Effect of Chromic Acid Concentrations, Current Density and Agitation on Chromium Coating Weights at 125° F. Plating Tests

| | Chromium Weights (Mg/ft2) | | | | | | | |
|---|---|---|---|---|---|---|---|---|
| | 200 FPM | | | | 600 FPM | | | |
| Bath | 107 ASF | 214 ASF | 428 ASF | 857 ASF | 107 ASF | 214 ASF | 428 ASF | 857 ASF |
| 1 | 1.2 | 1.6 | 2.9 | 3.6 | 0.8 | 1.5 | 2.3 | 3.2 |
| 2 | 1.5 | 2.0 | 3.7 | 5.0 | 0.8 | 1.5 | 3.0 | 3.5 |
| 3 | 1.8 | 4.2 | 4.8 | 5.5 | 0.8 | 2.6 | 4.7 | 5.4 |
| 4 | 2.0 | 4.5 | 5.2 | 6.0 | 0.8 | 4.0 | 5.0 | 5.5 |

Table 4 illustrates that the effect of agitation on the current efficiency is not significant.

The lacquer adhesion results are summarized in Table 5. The results indicate that lowering the concentration of the chromic acid for TFS process did not influence the lacquer adhesion of the TFS product. All the TFS panels showed excellent lacquer adhesion performance.

Diluted baths improved not only current efficiency of the plating (as demonstrated in coating weight per coulomb) but also surface quality of the TFS coating. The lacquer adhesion performance for all the panels studied was found to be satisfactory. It is also expected that a significant reduction in waste treatment cost will be achieved with the use of my baths of primarily $HCrO_4^-$.

Based on the findings discussed above, the following generalizations may be made:

1. While cell voltages are increased, current efficiency also increases with the reduction of chromic acid concentration.
2. Uniform stain-free surface quality improves with lower chromic acid concentration.
3. Waste treatment costs are reduced by using diluted chromic acid.
4. The cost of chromic acid is reduced by using less of it.
5. Maintenance costs are reduced by the reduction of corrosion caused by lower concentrations of chromic acid.

TABLE 4

Effect of Chromic Acid Concentrations, Current Density, and Agitation on Chromium Oxide Weights at 125° F. Plating Tests

| | Chromium Oxide Weights (Mg/ft2) | | | | | | | |
|---|---|---|---|---|---|---|---|---|
| | 200 FPM | | | | 600 FPM | | | |
| Bath | 107 ASF | 214 ASF | 428 ASF | 857 ASF | 107 ASF | 214 ASF | 428 ASF | 857 ASF |
| 1 | 1.2 | 1.2 | 1.0 | 0.5 | | 1.5 | 2.3 | 3.2 |
| 2 | 1.5 | 1.5 | 1.6 | 0.6 | 0.8 | 1.5 | 3.0 | 3.5 |
| 3 | 2.0 | 1.5 | 1.0 | 1.0 | 0.8 | 2.6 | 4.7 | 5.4 |
| 4 | 2.0 | 1.8 | 2.2 | 1.0 | 0.8 | 4.0 | 5.0 | 5.5 |

TABLE 5

Lacquer Adhesion Performance of TFS Panels Produced in Laboratory Circulation Cell

| | Lacquer Adhesion Test (ASTM D3359)* | | | | | | | |
|---|---|---|---|---|---|---|---|---|
| | 200 FPM | | | | 600 FPM | | | |
| Bath | 107 ASF | 214 ASF | 428 ASF | 857 ASF | 107 ASF | 214 ASF | 428 ASF | 857 ASF |
| 1 | 5 | 5 | 5 | 5 | 5 | 5 | 5 | 5 |
| 2 | 5 | 5 | 5 | 5 | 5 | 5 | 5 | 5 |
| 3 | 5 | 5 | 5 | 5 | 5 | 5 | 5 | 5 |
| 4 | 5 | 5 | 5 | 5 | 5 | 5 | 5 | 5 |

*5 = excellent adhesion, 0 = adhesion failure according to ASTM D3359-90

It was also noticed that diluted baths produced more uniform, stain free TFS coatings. This was because it is easier to rinse diluted plating solutions from the strip compared to more concentrate more viscous and more reactive chromic acid solutions. The concentrated chromic acid solutions are viscous and reactive with the coating itself, causing difficulties in rinsing, i.e. causing brown streaky stains. However, diluted baths are much easier to rinse and they are better able to tolerate poor rinsing conditions.

My process utilizing an electrolyte bath predominantly of $HCrO_4^-$ may readily be combined with further steps to reduce or eliminate the waste chromate solution to be treated. A more or less conventional rinse step conducted after the plating process is completed, results in a dilute solution of chromic acid which may be used to supplement the makeup of the electrolytic bath. Because I use a dilute electrolyte, the dilute chromic acid solution in the rinse will not disadvantageously dilute the bath—rather, a used rinse solution containing, for example, 3 to 10 g/L chromic acid may be recycled and used as a chemical makeup for the bath. Specifically, my invention includes a method of electroplating steel strip comprising passing the steel strip continuously through a chromic acid bath comprising predominantly $HCrO_4^-$ ions to form a coating on the steel strip of chromium and CrO, rinsing the strip with water, thereby forming a dilute rinse solution of chromic acid, collecting the dilute rinse solution of chromic acid, and recycling the dilute rinse solution to the chromic acid bath. Commonly the dilute rinse solution will contain 3–10% chromic acid. Such solutions can be used directly as all or part of the makeup for my bath, combined with other sources of chromic acid as necessary, or the dilute rinse solution may be concentrated somewhat by evaporation or otherwise if deemed desirable to achieve a desired concentration level for making a bath solution of from 5.8 to 40.6 g/L of $HCrO_4^-$ ions (5 to 35 grams per liter of chromic acid), preferably a bath solution made from 20 to 30 g/L of chromic acid, as stated elsewhere herein.

What is claimed is:

1. Method of making tin-free steel comprising electroplating steel in an aqueous bath comprising about 5.8 g/L to about 40.6 g/L $HCrO_4^-$.ions.

2. Method of claim 1 wherein said aqueous bath is made by dissolving 5 to 35 g/L of $CrO_3$ in water.

3. Method of claim 1 wherein said bath includes amounts of sulfate and fluoride ions effective to enhance chromium metal deposition on said steel.

4. Method of claim 1 wherein said bath has a pH from about 1.0 to about 1.5.

5. Method of claim 1 wherein the current efficiency of said electroplating is 20 to 40%.

6. Method of claim 1 wherein the current applied to effect said electroplating is from 100 to 1000 Amperes per square foot of steel surface.

7. Method of claim 1 conducted at a temperature of 110 to 130° F.

8. Method of continuously electroplating steel strip comprising passing said steel strip through a bath, at a temperature of 110 to 130° F., comprising about 50 to about 200 ppm sulfuric acid, about 500 to about 2000 ppm fluoride ion, and about 5.8 to about 40.6 g/L $HCrO_4^-$, to provide a residence time in said bath for said strip of 5 to 15 seconds.

9. Method of claim 8 conducted with a current density of 100 to 1000 Amp/$ft^2$.

10. Method of claim 9 conducted with a voltage of 3 to 17.

11. Method of claim 8 wherein the making of said bath includes dissolving $CrO_3$ in water and optionally diluting it to provide 5 to 35 grams per Liter of $CrO_3$ in water.

12. Method of claim 11 wherein 20–30 g/L of $CrO_3$ is provided.

13. Method of electroplating steel strip comprising passing said steel strip continuously through a chromic acid electroplating bath comprising predominantly $HCrO_4^-$ ions, rinsing said strip with water, thereby forming a dilute solution of chromic acid, collecting said dilute solution of chromic acid, and recycling said dilute solution to said bath.

14. Method of claim 13 wherein the concentration of $HCrO_4^-$ ions in said dilute solution is adjusted to 5.8 to 40.6 g/L during recycling.

* * * * *